US011189215B2

(12) United States Patent
Yoo et al.

(10) Patent No.: US 11,189,215 B2
(45) Date of Patent: Nov. 30, 2021

(54) DISPLAY DEVICE AND DRIVING METHOD THEREOF

(71) Applicant: Samsung Display Co., LTD., Yongin-si (KR)

(72) Inventors: Byoung Seok Yoo, Seoul (KR); Hoi Sik Moon, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/013,251

(22) Filed: Sep. 4, 2020

(65) Prior Publication Data

US 2021/0256894 A1 Aug. 19, 2021

(30) Foreign Application Priority Data

Feb. 17, 2020 (KR) ..... 10-2020-0018955

(51) Int. Cl.
*G09G 3/20* (2006.01)
*G09G 3/36* (2006.01)
*G09G 3/32* (2016.01)

(52) U.S. Cl.
CPC ..... *G09G 3/2007* (2013.01); *G09G 3/3688* (2013.01); *G09G 3/32* (2013.01); *G09G 2310/027* (2013.01); *G09G 2320/029* (2013.01); *G09G 2320/0233* (2013.01); *G09G 2360/127* (2013.01)

(58) Field of Classification Search
CPC ..... G09G 3/2007; G09G 3/3688; G09G 3/32; G09G 2360/127; G09G 2320/029; G09G 2320/0233; G09G 2310/027
See application file for complete search history.

(56) References Cited

U.S. PATENT DOCUMENTS

2011/0012908 A1 1/2011 Daly
2011/0157111 A1* 6/2011 Lee ..... G09G 3/3406 345/205
2013/0249886 A1* 9/2013 Fujimori ..... G09G 3/344 345/212
2015/0130866 A1* 5/2015 Bae ..... G09G 3/3225 345/694

FOREIGN PATENT DOCUMENTS

KR 1020080016046 A 2/2008
KR 1020090070316 A 7/2009
KR 1020150030013 A 3/2015
KR 1020180062332 A 6/2018
KR 101908686 B1 10/2018
KR 102041513 B1 11/2019

* cited by examiner

*Primary Examiner* — Andrew Sasinowski
(74) *Attorney, Agent, or Firm* — Cantor Colburn LLP

(57) ABSTRACT

A display device includes a plurality of pixels, and a plurality of data lines connected to the plurality of pixels; a data driver for transmitting a data voltage to the data line; and a signal controller for receiving input image signals from the outside and outputting a digital image signal to the data driver. The signal controller includes an adjacent image signal compensator for comparing input gray data of the input image signals to be continuously input to the data line and generating adjacent image signal compensation data based on the comparison, and a pixel characteristic compensator for generating pixel characteristic compensation data according to a characteristic of a pixel to be displayed.

17 Claims, 16 Drawing Sheets

FIG. 5

| N line | N-1 line | | | | | | | | | | | | | | | | | |
|---|---|---|---|---|---|---|---|---|---|---|---|---|---|---|---|---|---|---|
| | 0G | 8G | 16G | 24G | 32G | 40G | ... | 176G | 184G | 192G | 200G | 208G | 216G | 224G | 232G | 240G | 248G | 256G |
| 8G | 1.00 | 0.00 | 0.00 | 0.03 | 0.07 | 0.08 | ... | 0.42 | 0.44 | 0.46 | 0.48 | 0.50 | 0.51 | 0.53 | 0.65 | 0.77 | 0.88 | 0.88 |
| 16G | 1.00 | 0.25 | 0.00 | 0.00 | 0.00 | 0.00 | ... | 0.39 | 0.41 | 0.46 | 0.48 | 0.50 | 0.51 | 0.53 | 0.65 | 0.77 | 0.88 | 0.88 |
| 24G | 1.00 | 0.32 | 0.09 | 0.00 | 0.00 | 0.00 | ... | 0.35 | 0.37 | 0.43 | 0.45 | 0.47 | 0.48 | 0.50 | 0.63 | 0.75 | 0.88 | 0.88 |
| 32G | 1.00 | 0.39 | 0.19 | 0.09 | 0.00 | 0.00 | ... | 0.33 | 0.36 | 0.39 | 0.41 | 0.43 | 0.46 | 0.48 | 0.61 | 0.74 | 0.87 | 0.87 |
| 64G | 1.00 | 0.47 | 0.28 | 0.20 | 0.11 | 0.08 | ... | 0.17 | 0.19 | 0.38 | 0.41 | 0.43 | 0.46 | 0.48 | 0.61 | 0.74 | 0.87 | 0.87 |
| 96G | 1.00 | 0.55 | [illegible] | 0.28 | 0.20 | 0.18 | ... | 0.10 | 0.12 | 0.20 | 0.22 | 0.24 | 0.25 | 0.27 | 0.45 | 0.64 | 0.82 | 0.82 |
| 128G | 1.00 | 0.58 | 0.41 | 0.34 | 0.27 | 0.24 | ... | 0.00 | 0.00 | 0.14 | 0.15 | 0.17 | 0.19 | 0.20 | 0.40 | 0.60 | 0.80 | 0.80 |
| 160G | 1.00 | 0.62 | 0.46 | 0.39 | 0.33 | 0.30 | ... | 0.04 | 0.02 | 0.07 | 0.08 | 0.10 | 0.12 | 0.14 | 0.35 | 0.57 | 0.78 | 0.78 |
| 192G | 1.00 | 0.65 | 0.50 | 0.45 | 0.39 | 0.37 | ... | 0.13 | 0.10 | 0.00 | 0.00 | 0.00 | 0.00 | 0.00 | 0.00 | 0.00 | 0.00 | 0.77 |
| 224G | 1.00 | 0.69 | 0.55 | 0.50 | 0.45 | 0.43 | ... | 1.00 | 1.00 | 0.08 | 0.063 | 0.042 | 0.021 | 0.00 | 0.00 | 0.00 | 0.00 | 0.75 |

DISPLAY DEVICE AND DRIVING METHOD THEREOF

This application claims priority to Korean Patent Application No. 10-2020-0018955, filed on Feb. 17, 2020, and all the benefits accruing therefrom under 35 U.S.C. § 119, the content of which in its entirety is herein incorporated by reference.

BACKGROUND

(a) Field

The present disclosure relates to a display device and a driving method thereof, and particularly relates to a display device for displaying images by compensating a case of an insufficient amount of charging, and a driving method thereof.

(b) Description of the Related Art

A liquid crystal display and an emissive display device (e.g., an organic light emitting device) are widely used as display devices.

The liquid crystal display includes two sheets of display panels on which field generating electrodes such as a pixel electrode and a common electrode are disposed and a liquid crystal layer disposed therebetween, an electric field is generated on a liquid crystal layer by applying a data voltage to the field generating electrode, and gray scales are then displayed by determining alignment of liquid crystal molecules of the liquid crystal layer and controlling polarization of incident light.

The emissive display device has pixels including light emitting diodes ("LED") (e.g., organic light emitting diodes), and is a display device for displaying gray scales by controlling a current applied to the light emitting diodes (LED).

The display device changes the displayed gray scale by controlling a data voltage flowing through a data line, the data voltage corrects an image signal applied from the outside of the display device, and the corrected signal is converted into an analog voltage.

SUMMARY

The described technology has been made in an effort to prevent deterioration of display quality of a display device.

The described technology has been made in another effort to prevent a pixel from being poorly charged. The described technology has been made in another effort to prevent the same gray scale from being displayed with different luminance with respect to position. The described technology has been made in another effort to reduce the capacity of a memory used to the display device.

An exemplary embodiment provides a display device including a display panel including a plurality of pixels, and a plurality of data lines connected to the plurality of pixels; a data driver which transmits a data voltage to the data line; and a signal controller which receives input image signals from the outside and outputs a digital image signal to the data driver, where the signal controller includes an adjacent image signal compensator which compares input gray data of the input image signals to be continuously input to the data line and generates adjacent image signal compensation data based on the comparison, and a pixel characteristic compensator which generates pixel characteristic compensation data according to a characteristic of a pixel to be displayed.

The display device may further include a first memory which stores information used when the adjacent image signal compensator generates the adjacent image signal compensation data, where the information stored in the first memory may include some reference gray scales from among the entire gray scales.

The information stored in the first memory may further include a weight value table, and the weight value table may be applied in the case in which the probability of generating a drawback in charging is low to thus generate the adjacent image signal compensation data, and the drawback in charging may include insufficient charging.

The adjacent image signal compensator may generate the adjacent image signal compensation data by using an option of multiples.

The adjacent image signal compensator may generate the adjacent image signal compensation data by interpolating the gray scales except for the reference gray scale from among the entire gray scale.

The display device may further include a second memory which stores information used when the pixel characteristic compensator generates the pixel characteristic compensation data.

The information stored in the second memory may include pixel characteristic information on only a representative pixel set by sampling or downsizing some of the plurality of pixels.

The representative pixel may be provided in plural, and the pixel characteristic compensator may generate the pixel characteristic compensation data based on the pixel characteristic information of four representative pixels adjacent to the pixel to be displayed and a distance from each of the four representative pixels to the pixel to be displayed.

The pixel characteristic compensator may generate the pixel characteristic compensation data by using an option of multiples.

The pixel characteristic compensator may divide the display panel into a plurality of regions, and may compensate the respective regions with the options of multiples different from each other to generate the pixel characteristic compensation data.

The signal controller may further include a frame memory which stores the input image signal for each frame, and transmits the input image signal to the adjacent image signal compensator or the pixel characteristic compensator.

The frame memory may transmit the input image signal to the adjacent image signal compensator, and the adjacent image signal compensator may transmit the adjacent image signal compensation data to the pixel characteristic compensator to generate the digital image signal.

The frame memory may transmit the input image signal to the pixel characteristic compensator, and the pixel characteristic compensator may transmit the pixel characteristic compensation data to the adjacent image signal compensator to generate the digital image signal.

The signal controller may further include a synthesizer, the frame memory may transmit the input image signal to the adjacent image signal compensator and the pixel characteristic compensator, and the adjacent image signal compensator and the pixel characteristic compensator may transmit the adjacent image signal compensation data and the pixel characteristic compensation data, respectively, to the synthesizer to generate the digital image signal.

The signal controller may further include a third memory which stores information for both compensation based on the input gray data to be continuously input and compensation according to the characteristic of the pixel to be displayed, and the adjacent image signal compensator and the pixel characteristic compensator may configure one compensator, and may generate the digital image signal by using the information stored in the third memory.

Another embodiment provides a method for driving a display device, including generating adjacent image signal compensation data by comparing input gray data of input image signals to be continuously input to one data line; generating pixel characteristic compensation data with respect to a position of a pixel to be displayed; and converting a digital image signal generated by the generating of the adjacent image signal compensation data and the generating of the pixel characteristic compensation data into a data voltage and applying the data voltage.

The generating of the adjacent image signal compensation data may include generating the adjacent image signal compensation data by using a weight value table when a probability in which a pixel has a charging drawback is low, and the charging drawback may include insufficient charging.

The generating of the pixel characteristic compensation data may include setting a representative pixel by sampling or downsizing a plurality of pixels included in a display panel of the display device, where the representative pixel may be provided in plural, storing pixel characteristic information on the representative pixel, and generating the pixel characteristic compensation data based on the characteristic information of four representative pixels adjacent to the pixel to be displayed and a distance from each of the four representative pixels to the pixel to be displayed.

The generating of the adjacent image signal compensation data or the generating of the pixel characteristic compensation data may include using an option of multiples.

The generating of the pixel characteristic compensation data may include dividing the display panel into a plurality of regions, and compensating the respective regions with different weight values to generate the pixel characteristic compensation data.

According to the exemplary embodiments, the image signal input from the outside may be corrected to prevent deterioration of display quality, bad charging into the pixel may not be generated, and the same gray scale may display the same luminance irrespective of the position of the pixel. The capacity of the used memory may be reduced by reducing the size of data used for correcting the image signal and also reducing the size of stored data.

BRIEF DESCRIPTION OF THE DRAWINGS

FIG. 5 shows an example of a weight value table used in a display device according to an exemplary embodiment.

DETAILED DESCRIPTION

Figure 1:
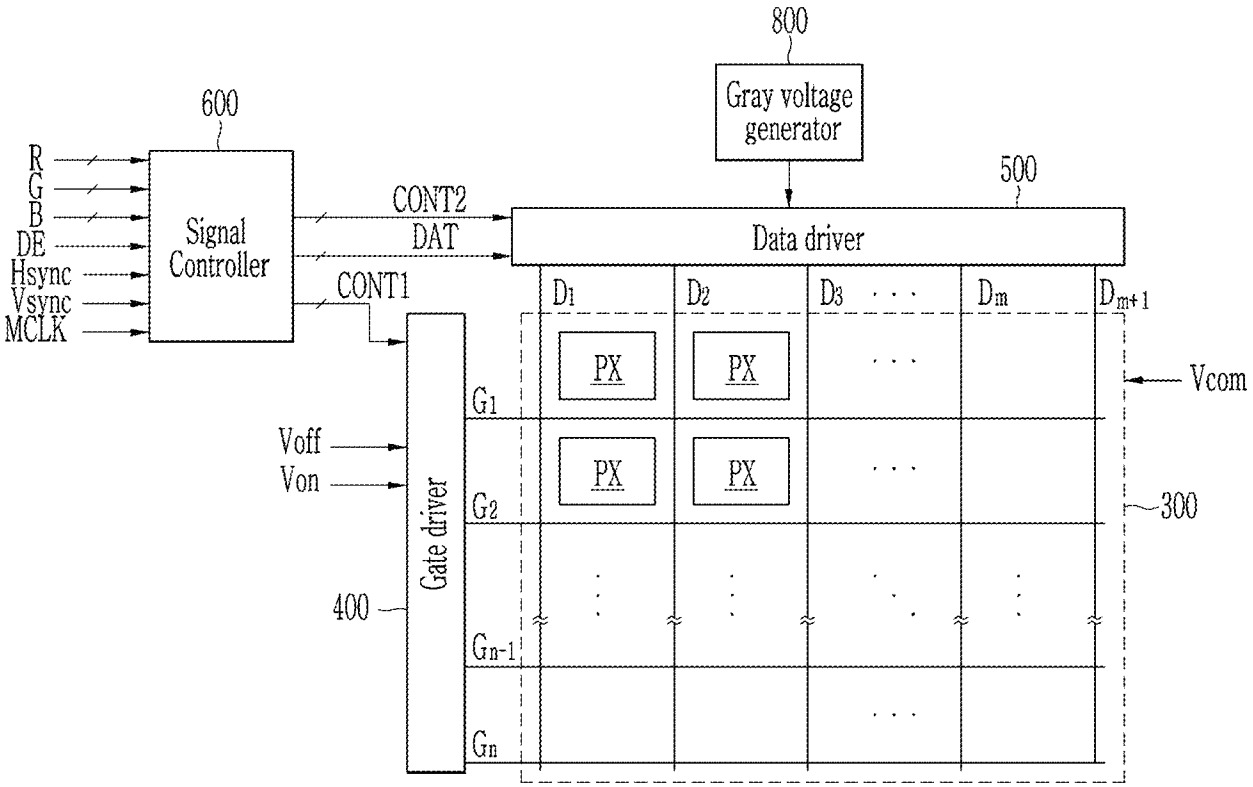
FIG. 1 shows a block diagram of a display device according to an exemplary embodiment.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

The drawings and description are to be regarded as illustrative in nature and not restrictive, and like reference numerals designate like elements throughout the specification.

Further, the size and thickness of each configuration shown in the drawings are arbitrarily shown for better understanding and ease of description, and the present invention is not limited thereto. In the drawings, the thickness of layers, films, panels, regions, etc., are exaggerated for clarity. For better understanding and ease of description, the thicknesses of some layers and areas are exaggerated.

It will be understood that when an element such as a layer, film, region, or substrate is referred to as being "on" another element, it can be directly on the other element or intervening elements may also be present. In contrast, when an element is referred to as being "directly on" another element, there are no intervening elements present. The word "on" or "above" means positioned on or below the object portion, and does not necessarily mean positioned on the upper side of the object portion based on a gravitational direction.

Unless explicitly described to the contrary, the word "comprise" and variations such as "comprises" or "comprising" will be understood to imply the inclusion of stated elements but not the exclusion of any other elements.

The phrase "on a plane" means viewing the object portion from the top, and the phrase "on a cross-section" means viewing a cross-section of which the object portion is vertically cut from the side.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items.

A display device according to an exemplary embodiment will now be described with reference to FIG. 1.

FIG. 1 shows a block diagram of a display device according to an exemplary embodiment.

As shown in FIG. 1, the display device includes a display panel 300, a gate driver 400 and a data driver 500 which are connected to the display panel 300, a gray voltage generator 800 connected to the data driver 500, and a signal controller 600 for controlling them.

The display panel 300 includes a plurality of signal lines G1-Gn and D1-Dm, and a plurality of pixels PX connected to the plurality of signal lines in an equivalent circuit viewpoint. In the case of the liquid crystal display, one pixel PX includes two electrodes (e.g., a pixel electrode and a common electrode) and a liquid crystal layer, and controls a direction in which liquid crystal molecules of the liquid crystal layer are arranged by controlling an intensity of an electric field between the pixel electrode and the common electrode. In this instance, in the case of the pixel PX in a vertical alignment mode, the pixel electrode and the common electrode are on opposite sides of the liquid crystal layer, respectively. Further, in the case of the pixel PX in a horizontal alignment mode, the pixel electrode and the common electrode are on one side of the liquid crystal layer.

In addition, in the emissive display device in an exemplary embodiment, the pixel PX includes a light emitting diode ("LED"), a driving transistor for transmitting a current to the light emitting diode (LED), and at least one switching transistor, An output current of the driving transistor is determined according to an input data voltage, and the light emitting diode (LED) displays luminance according to the output current.

The liquid crystal panel in the vertical alignment mode will be mainly described from among the various display panels, and when there are differences between the same and other types of display panels, they will be described in the corresponding portions.

The signal lines G1-Gn and D1-Dm include a plurality of gate lines G1-Gn for transmitting gate signals (also referred to as scan signals) and a plurality of data lines D1-Dm for transmitting data voltages. The gate lines G1-Gn substantially extend in a row direction, and the data lines D1-Dm substantially extend in a column direction.

The pixels PX may further include an additional signal line extending in the row direction. For example, in the emissive display device, the display panel 300 may include a previous-stage gate line for transmitting a previous-stage gate signal, or an emission signal line for applying an emission signal for transmitting the output current to the light emitting diode (LED). It may include an initialization signal line for applying an initialization signal.

Each pixel PX, for example, the pixel PX connected to an i-th (i=1, 2, . . . , n) gate line Gi and a j-th (j=1, 2, . . . , m) data line Dj includes a switching transistor connected to signal lines Gi and Dj, and a liquid crystal capacitor and a storage capacitor connected the signal lines.

The switching transistor is a three-terminal element such as a thin film transistor installed on a lower panel, and includes a control terminal connected to the gate line Gi, an input terminal connected to the data line Dj, and an output terminal connected to the liquid crystal capacitor and the storage capacitor.

The liquid crystal capacitor includes a pixel electrode of the lower panel and a common electrode of an upper panel as two terminals, and the liquid crystal layer between the two electrodes functions as a dielectric material. The pixel electrode is connected to the switching transistor, and the common electrode is on an entire side of the upper panel and receives a common voltage Vcom. In the pixel PX in the horizontal alignment mode, the common electrode may be installed on the lower panel, and in this instance, at least one of the electrodes may be formed to be linear or bar-shaped, and the other may have a panel-type configuration.

The storage capacitor performing an ancillary function of the liquid crystal capacitor is configured by overlapping an individual voltage line (not shown) installed on the lower panel and the pixel electrode with an insulator therebetween, and a predetermined voltage such as the common voltage Vcom is applied to the individual voltage line. However, the storage capacitor may be provided when the pixel electrode overlaps the previous-stage gate line with an insulator as a medium.

To realize the displaying of colors, each pixel PX displays one of primary colors, and a bundle of pixels PX for displaying three colors display various colors. Pixels PX for displaying four colors may be combined and driven in another exemplary embodiment. For this purpose, a color filter may be included, or a color converting layer including a quantum dot may further be included.

A polarization layer for polarizing light is formed on opposite sides of the display panel 300, respectively, in the case of the liquid crystal display. In another way, a polarization layer such as a polarization film may be formed on the display panel on one side of the emissive display device, and it may be included so that the light input from the front side may not be reflected again, differing from the case of the liquid crystal display.

The gate driver 400 is connected to the gate lines G1-Gn of the display panel 300, and applies a gate signal (or a scan signal) that is a combination of a gate-on voltage Von and a gate-off voltage Voff to the gate lines G1-Gn. The gate driver 400 may be formed by the same process when a transistor on the pixel PX is formed on the display panel 300. In this case, a gate driver 400 is on a portion of a non-display area on the display panel 300.

The data driver 500 is connected to the data lines D1-Dm of the display panel 300, selects a gray voltage from the gray voltage generator 800 and applies the same as a data voltage to the data lines D1-Dm. However, when the gray voltage generator 800 does not provide the entire voltages corresponding to the entire gray scales but provides only a predetermined number of reference gray voltages, the data driver 500 divides the reference gray voltages to generate gray voltages corresponding to the entire gray scales and selects a data signal from among them.

The gray voltage generator 800 generates an analog voltage (or a gray voltage: voltage corresponding to a gray scale) corresponding to a digital image signal DAT. In the case of the liquid crystal display, it may generate two voltages, and one thereof has a positive value on the common voltage Vcom and the other one thereof has a negative value.

The signal controller 600 controls the gate driver 400 and the data driver 500.

The driving devices 400, 500, 600, and 800 may be directly installed as at least one IC chip on the display panel 300, respectively, it may be installed on a flexible printed circuit film (not shown) and may be attached as a tape carrier package ("TCP") to the display panel 300, or it may be installed on a printed circuit board ("PCB") (not shown). In another exemplary embodiment, the driving devices 400, 500, 600, and 800 may be directly integrated with the display panel 300 together with the signal lines G1-Gn and D1-Dm, a thin film transistor, and a switching transistor. Further, the driving devices 400, 500, 600, and 800 may be integrated into a single chip, and in this case, at least one thereof or at least one circuit element configuring the driving devices 400, 500, 600, and 800 may be outside the single chip.

An operation of the display device will now be described.

The signal controller 600 receives input image signals R, G, and B and an input control signal for controlling displaying the image signals R, G, and B from an external graphics signal controller (not shown). The input control signal may exemplarily include a vertical synchronization signal Vsync, a horizontal synchronizing signal Hsync, a main clock signal MCLK, and a data enable signal DE.

The signal controller 600 properly compensates the input image signals R, G, and B according to an operating condition of the display panel 300 based on the input image signals R, G, and B and the input control signal. The signal controller 600 also generates a gate control signal CONT1 and a data control signal CONT2, transmits the gate control signal CONT1 to the gate driver 400, and transmits the data control signal CONT2 and the compensated digital image signal DAT to the data driver 500. A method for the signal controller 600 to compensate the input image signals R, G, and B and generate the digital image signal DAT will be described in detail with reference to FIG. 2 to FIG. 16.

The gate control signal CONT1 includes a scanning start signal for instructing a scanning start, and at least one clock signal for controlling an output period of the gate-on voltage Von. The gate control signal CONT1 may further include an output enable signal for controlling a duration of the gate-on voltage Von.

The data control signal CONT2 includes a horizontal synchronization start signal for notifying a transmission start of image data on the pixel PX by one row unit of the pixels, a load signal for applying a data signal to the data lines D1-Dm, and a data clock signal. In the case of the liquid crystal display, the data control signal CONT2 may further include an inversion signal for inverting voltage polarity (hereinafter, voltage polarity of the data signal for the common voltage will be referred to as the polarity of the data signal) of the data signal for the common voltage Vcom. According to the data control signal CONT2 from the signal controller 600, the data driver 500 receives a digital image signal DAT on the pixel PX by one row unit of the pixels, converts the digital image signal DAT into an analog data voltage by selecting the gray voltage corresponding to each digital image signal DAT, and applies the same to the corresponding data lines D1-Dm.

The gate driver 400 applies the gate-on voltage Von to the gate lines G1-Gn according to the gate control signal CONT1 from the signal controller 600 to turn on the switching transistor connected to the gate lines G1-Gn. The data signal applied to the data lines D1 to Dm is applied to the corresponding pixel PX through the turned-on switching transistor.

In the liquid crystal display, a difference between the data voltage applied to the pixel PX and the common voltage Vcom is represented by a charging voltage of the liquid crystal capacitor, that is, a pixel voltage. The liquid crystal molecules are differently arranged according to the size of the pixel voltage, and the polarization of light passing through the liquid crystal layer changes. The change of polarization is shown to be a change of transmittance of light by a polarizer attached to the display panel 300.

In the emissive display device, the data voltage applied to the pixel PX is stored in the storage capacitor to determine the size of the output current of the driving transistor, and the current output by the driving transistor is applied to the light emitting diode (LED) to emit light Luminance displayed by the light emitting diode (LED) increases according to the size of the output current of the driving transistor.

By repeating the above-noted process for each one horizontal period [which corresponds to one period of the horizontal synchronizing signal Hsync and the data enable signal DE], the gate-on voltage Von is sequentially applied to the gate lines (G1-Gn) to thus apply the data signal to the entire pixels PX and display images of one frame.

In the case of the liquid crystal display, inversion driving for changing the polarity of the data voltage for each frame may be performed.

A process for the signal controller 600 to generate a digital image signal DAT from the input image signals R, G, and B will now be described with reference to FIG. 2 to FIG. 16.

A compensating process for generating a digital image signal DAT will now be described with reference to FIG. 2 and FIG. 3, and in general, the compensating process may be performed by a first compensator 610 (adjacent image signal compensator) and a second compensator 620 (pixel characteristic compensator).

Figure 2:
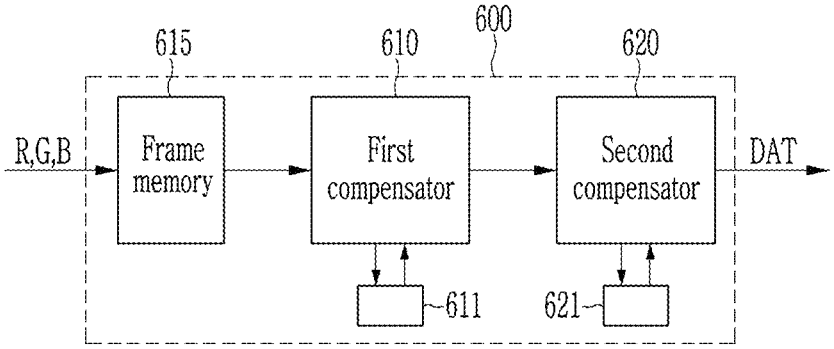
FIG. 2 shows a block diagram of a signal controller in a display device according to an exemplary embodiment.
Figure 3:
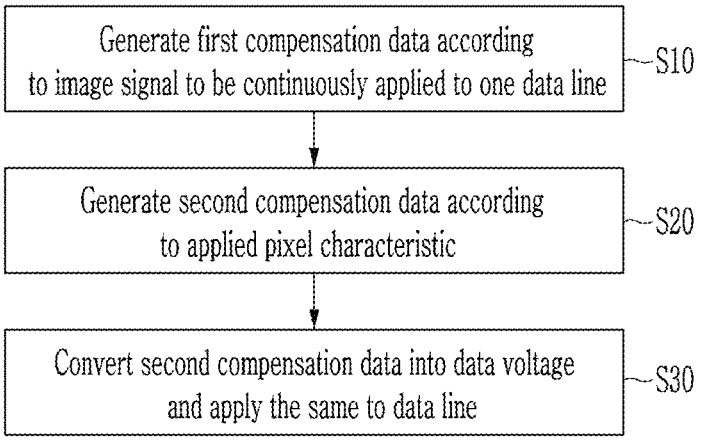
FIG. 3 shows a flowchart of a method for driving a display device according to an exemplary embodiment.

FIG. 2 shows a block diagram of a signal controller in a display device according to an exemplary embodiment, and FIG. 3 shows a flowchart of a method for driving a display device according to an exemplary embodiment.

FIG. 2 illustrates an internal block diagram of a signal controller 600 in a display device. The signal controller 600 shown in FIG. 2 illustrates a block diagram of a compensation process for generating a digital image signal DAT. As a result, the signal controller 600 may further include a block for performing various processes in addition to the block shown in FIG. 2.

Referring to FIG. 2, the signal controller 600 includes a frame memory 615, the first compensator 610, the second compensator 620, a first memory 611, and a second memory 621.

When receiving input image signals R, G, and B from an external graphics signal controller, the frame memory 615 stores the same for respective frames, and when receiving the input image signals R, G, and B of the next frame, the frame memory 615 may transmit the stored input image signals R, G, and B of the existing frame to another frame memory, and may store the input image signals R, G, and B of a new current frame. FIG. 2 illustrates one frame memory 615, but the frame memory 615 may include a structure for storing input image signals R, G, and B of at least two frames, or it may include at least two frame memories in another exemplary embodiment.

The input image signals R, G, and B stored in the frame memory 615 are converted into first compensation data by the first compensator 610. The first compensator 610 compares input image signals R, G, and B to be applied in advance to one of the data lines D1 to Dm and the current input image signals R, G, and B from among the input image signals R, G, and B of one frame, (that is, compares gray data of the input image signals to be continuously input to one data line) and compensates the current input image signals R, G, and B to thus generate first compensation data. Information on a compensation degree according to a difference between the input image signals R, G, and B to be applied in advance and the current input image signals R, G, and B is stored in the first memory 611. The information may be stored in a lookup table form, and this lookup table form may be referred to as a first lookup table. The first lookup table may store the input image signals R, G, and B to be applied in advance, and a first compensation data value on the current input image signals R, G, and B.

The first compensator 610 processes a compensation based on the applied input image signals R, G, and B that are adjacent to one of the data lines D1 to Dm, so the first compensator 610 is also referred to as an adjacent image signal compensator, and the first compensation data are also referred to as adjacent image signal compensation data.

The first compensation data are converted to second compensation data by the second compensator 620. The second compensator 620 generates the second compensation data by compensating the first compensation data according to a characteristic of the pixel PX to be actually applied.

When the second compensator 620 generates the second compensation data, the second compensator 620 uses information on the characteristic of the pixel PX stored in the second memory 621 to generate the second compensation data. The information stored in the second memory 621 may be characteristic information on the pixel for a position of the pixel, it may have a lookup table form, and for this purpose, it will also be referred to as a second lookup table. Here, the characteristic of the pixel PX is determined regarding whether a specific gray scale (or luminance) displayed by the pixel PX corresponds to a target gray scale (or luminance) based on the data voltage applied to the pixel PX. A degree for changing the data voltage may be stored in the second memory 621, and may be used when the specific gray scale displayed by the pixel PX and the target gray scale do not correspond to each other. Further, the characteristic of the pixel PX stored in the second memory 621 is influenced by the position of the pixel PX, and it may have a similar characteristic between adjacent pixels PX.

The second compensator 620 processes compensation based on the characteristic of the pixel PX, so the second compensator 620 is also referred to as a pixel characteristic compensator, and the second compensation data are also referred to as pixel characteristic compensation data.

The second compensation data generated by the second compensator 620 are transmitted as a digital image signal DAT to the data driver 500. The data driver 500 converts the same into a corresponding analog data voltage by using the gray voltage generator 800 and outputs the corresponding analog data voltage to the data lines D1 to Dm.

FIG. 3 shows the above-noted operation as a flowchart.

As shown in FIG. 3, first compensation data are generated based on input image signals R, G, and B to be sequentially applied to one of the data lines D1 to Dm from among the input image signals R, G, and B that are input from an external graphics signal controller (S10). The stage of S10 is performed by the first compensator 610, and the first compensation data may be generated by using information on the first lookup table stored in the first memory 611.

The second compensation data are generated by considering the characteristic of the pixel PX to which the first compensation data will be applied (S20). The characteristic of the pixel PX relates to which position the pixel PX is disposed on the display panel 300, which is because the characteristics of the adjacent pixels PX are different from each other. Other various characteristics in addition to the position may be considered as the characteristic of the pixel PX. The stage of S20 is performed by the second compensator 620, and the second compensation data may be generated by using the information on the second lookup table stored in the second memory 621.

When the second compensation data are transmitted as a digital image signal DAT to the data driver 500, they are converted into an analog data voltage by using the gray voltage generator 800, and the same is applied to the respective data lines D1 to Dm of the display panel 300 (S30). The stage of S30 is performed by the data driver 500, and in this instance, the same is converted into a data voltage by using the gray voltage generated by the gray voltage generator 800.

In an exemplary embodiment described with reference to FIG. 2 and FIG. 3, it is illustrated that the first compensator 610 is operated and the second compensator 620 is then operated. In another exemplary embodiment, the second compensator 620 may be operated first, or the two compensators 610 and 620 may be simultaneously operated, and results are combined to generate a final digital image signal DAT, or the compensation operation may be performed altogether by using one memory and a compensator. This will be described in a later portion of the present specification with reference to FIG. 13 to FIG. 16.

A method for a first compensator 610 to generate first compensation data according to an exemplary embodiment will now be described with reference to FIG. 4 to FIG. 6.

Figure 4:
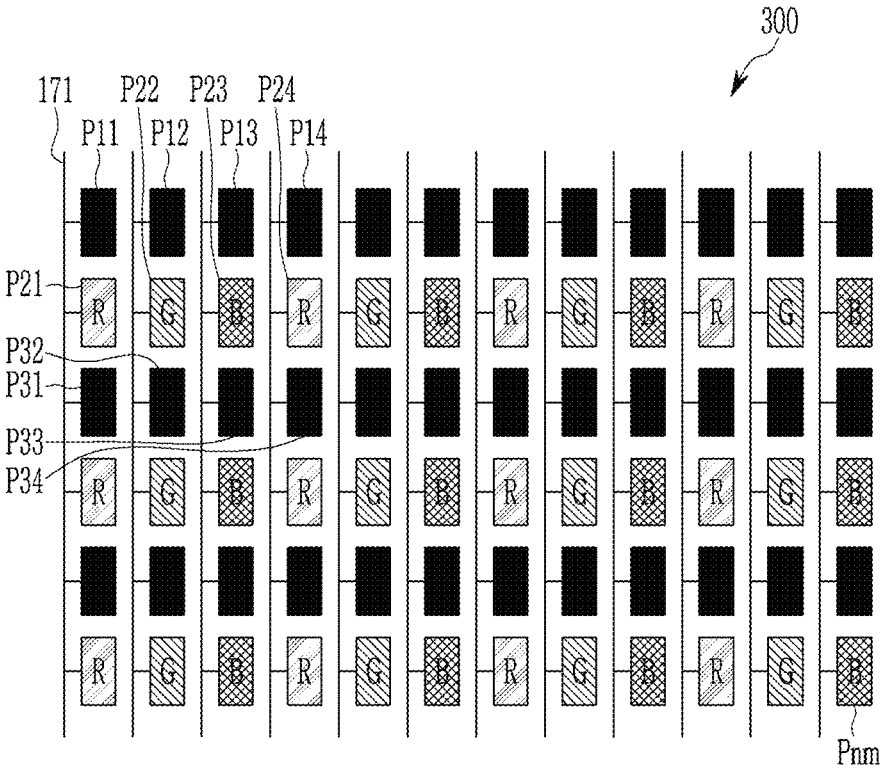
FIG. 4 shows a panel configuration of a display device and voltages applied to respective pixels according to an exemplary embodiment.
Figure 6:
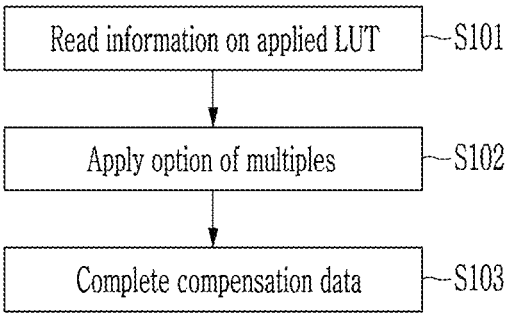
FIG. 6 shows a flowchart of a method for compensating data by using an option of multiples according to an exemplary embodiment.

FIG. 4 shows a panel configuration of a display device and voltages applied to respective pixels according to an exemplary embodiment, FIG. 5 shows an example of a weight value table used in a display device according to an exemplary embodiment, and FIG. 6 shows a flowchart of a method for compensating data by using an option of multiples according to an exemplary embodiment.

FIG. 4 illustrates a connection of a data line 171 and respective pixels P11 to Pnm on the display panel 300, and a data voltage applied to each pixel.

A connection relationship of the data line 171 and the respective pixels P11 to Pnm shown in FIG. 4 will now be described.

In FIG. 4, the data line 171 extending in a column direction branches out in one direction (e.g., row direction) to be connected to the respective pixels P11 to Pnm. As a result, the data line 171 is not connected to the pixels P11 to Pnm in another direction (i.e., an opposite direction to the one direction).

In the data voltage continuously applied to the respective data lines 171 on the display panel 300, a black data voltage for displaying a black gray scale 0 (0G) and a gray data voltage for displaying a specific gray scale are repeatedly applied. As a result, the black color is displayed on the pixel in an odd-numbered row, and respective colors are displayed on the even-numbered pixel by writing them as R, G, and B.

Regarding the data voltage applied to the data line 171, in the case of displaying the black color and the case of displaying the specific gray scale are continuous, the drawback that the pixel for displaying a specific gray scale is insufficiently charged may be very probably generated. The case in which the probability of insufficient charging is high will also be referred to as a worst case hereinafter. The data to be compensated need be determined with reference to this worst case.

Respective compensation data values may be determined for all the gray scales and they may be used to generate first compensation data, but in this case, capacity thereof to be stored in the first memory 611 increases as a drawback. Therefore, to reduce the drawback, in an exemplary embodiment, a method for determining a reference gray scale, determining the compensation data value for the reference gray scale, storing the same in the first memory 611 as a first lookup table, and determining the first compensation data through interpolation for the gray scale that is not the reference gray scale is used. Referring to FIG. 5, the reference gray scale according to an exemplary embodiment uses 8G, 16G, 24G, 32G, 64G, 96G, 128G, 160G, 192G, and 224G from among 0G to 255G.

When the gray scale 0 (0G) is changed to the reference gray scale, the data to be compensated are determined through a test, formed to be a first lookup table, and stored in the first memory 611. Further, the first lookup table stores how much it would be compensated when the data voltage approaches, rises, and changes between the reference voltages as a value that is determined by a test.

In another way, in an exemplary embodiment, the value that is determined through a test may be used when the data voltage falls and changes (i.e., when the probability of insufficient charging is low). However, when the case in which the data voltage falls is considered, a long time is needed in forming one lookup table when it has to be determined through a test, so in the present exemplary embodiment, a weight value table shown in FIG. 5 is used.

In the weight value table shown in FIG. 5, the N−1 line signifies a previous row, and it corresponds to the data voltage that is applied in advance in one data line 171. Further, the N line signifies the present row. In FIG. 5, R represents a case when the data voltage rises, F represents a case when the data voltage falls, and the case when the data voltage falls (F) is identified by color in FIG. 5.

The weight value stored in the case (F) in which the data voltage falls in FIG. 5 may be applied as a product of a weight value and a numerical value applied when the data voltage rises. As a result, information given when the data voltage rises may compensate up to the case (F) in which the data voltage falls, and the first memory 611 with small capacity may be used as it is only needed to additionally store the weight value table.

FIG. 5 describes the case of a vertical alignment ("VA") mode of the liquid crystal display. That is, the worst case is generated when the data voltage rises in the liquid crystal display in the vertical alignment (VA) mode, so it is described that the respective data are found in detail when the data voltage rises, and the compensation data are generated by using the weight value table when the data voltage falls. However, in the case of a horizontal alignment mode of the liquid crystal display, the worst case is generated when the data voltage falls, so the compensation data when the data voltage rises may be generated by using the weight value table.

In FIG. 5, the case in which the gray scale in the previous row is 0G is expressed with a square box, and this portion corresponds to the worst case, so it is desirable to store the first compensation data in advance, and the weight values are 1, so the stored first compensation data are used as they are to thus generate no drawback in a charging rate.

The first compensation data when the data voltage rises need to have a greater value than the value of the first compensation data when the greatest gray scale is expressed. The first compensation data at this time have large values, so the memory for storing the same need to increase. Hence, in the present exemplary embodiment, the case of applying the first compensation data may have a greater value without increasing the value of the first compensation data having a maximum value by using an option of multiples as shown in FIG. 6.

Referring to FIG. 6, the option of multiples may be as follows.

To determine the first compensation data, stored information (i.e., lookup table ("LUT") information) is brought from the first memory 611 (S101).

It is determined whether to apply an option of multiples, and a stage of applying an option of multiples is performed (S102). Here, the applicable option of multiples may include various options of multiples, such as twice, three times, or seven times, and one option of multiples may be applied by determining whether there is a need to apply the option of multiples and what option of multiples will be applied.

The data stored in the lookup table (LUT) have a small value that is insufficient in generating the final first compensation data. In an exemplary embodiment, the gray scale is set to include 0G to 127G, and regarding the greater value, the first compensation data are generated through the option of multiples given below. As a result of applying the option of multiples, the final first compensation data are completed (S103).

In the above, the case of applying to the connection relationship of the data line 171 and the pixels P11 to Pnm as shown in FIG. 4 has been described. However, in another exemplary embodiment, it may be applied to the display panel 300 having a different connection relationship, one example of which is shown in FIG. 7.

Figure 7:
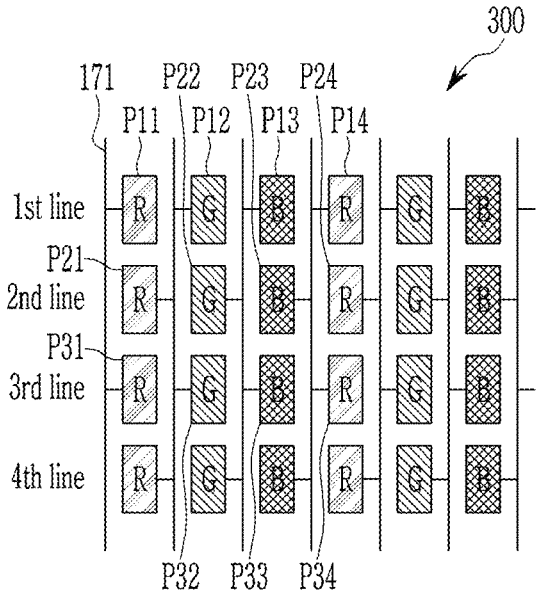
FIG. 7 shows a connection relationship between data lines and pixels in a display device according to an exemplary embodiment.

FIG. 7 shows a connection relationship between data lines and pixels in a display device according to an exemplary embodiment.

FIG. 7 illustrates a display panel 300 on which a case in which the data line 171 extending in a column direction branches out in one direction (e.g., the row direction) to reach the pixels P11 to Pnm, and a case in which the same branches out in another direction that is opposite the one direction to reach the pixels P11 to Pnm are repeatedly disposed. In an exemplary embodiment described with reference to FIG. 7, the continuous data voltage applied to one data line 171 is applied to pixels that are alternately arranged (or in a zigzag way), so this will also be referred to as a zigzag connection structure.

In the zigzag connection structure shown with reference to FIG. 7, as shown in FIG. 4, the first compensation data in the worst case, that is, when the gray scale rises to the reference gray scale from the gray scale 0 (0G), are determined, and the first compensation data when the gray scale falls are determined by using a weight value table (refer to FIG. 5) to reduce a time used to acquisition of data. Further, as shown in FIG. 6, the capacity of the first memory 611 used by applying the option of multiples may be reduced.

The option of multiples has been described with reference to FIG. 6 to be used to find the first compensation data, and the capacity of the second memory 621 may be used by using the option of multiples when finding second compensation data to be described below.

A method for generating second compensation data based on the characteristic of the pixel PX will now be described with reference to FIG. 8 to FIG. 12.

Regarding all the pixels PX disposed on the display panel 300, it may be preferable to understand the characteristics (e.g., when the same data voltage is applied, some pixels are accurately charged and other pixels are less charged) of the respective pixels PX, reflect them, and perform compensation by reflecting them.

However, when processed in this way, a subject stored in the second memory 621 increases, and a time for obtaining such information may be very long. Particularly, an adjacent pixel PX is formed by a substantially same process, so it is common to have the same characteristic, and hence, in the present exemplary embodiment, characteristic data are stored in the second memory 621 for some pixels PX through sampling, and based on this, compensation is performed with respect to position to generate second compensation data.

A method for storing the characteristic of some representative pixels (Pr) in the second memory 621 through sampling, and generating second compensation data on the entire pixels PX by using the stored characteristic, will now be described with reference to FIG. 8 and FIG. 9.

Figure 8:
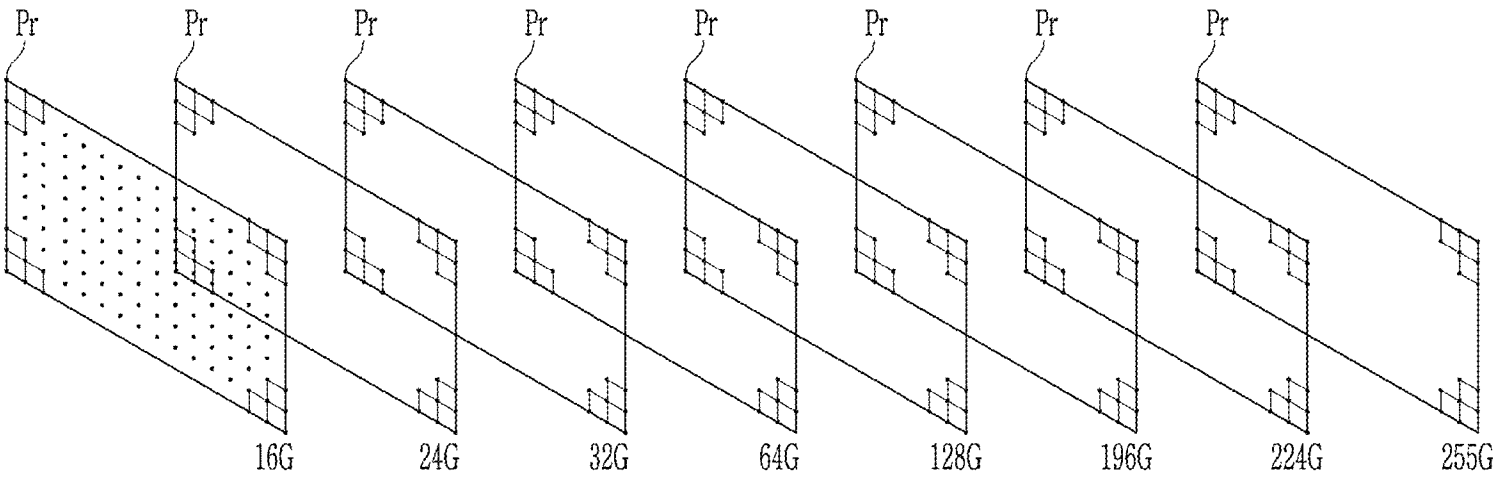
FIG. 8 shows an example of a representative pixel in a display device according to an exemplary embodiment.
Figure 9:
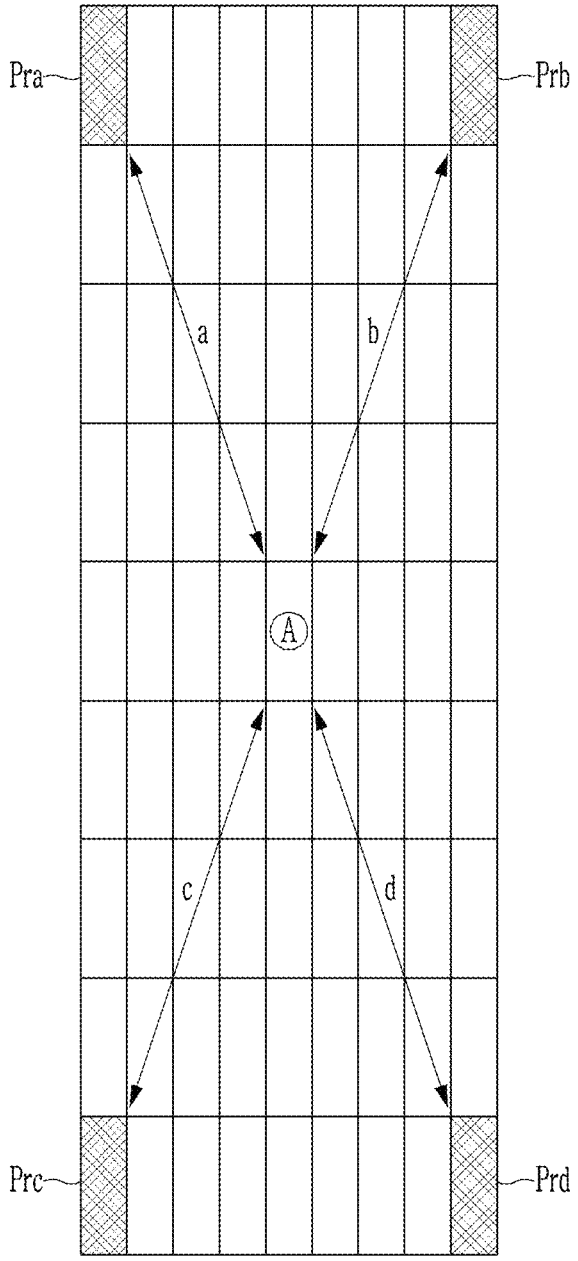
FIG. 9 shows a compensation method according to positions of pixels in a display device according to an exemplary embodiment.

FIG. 8 shows an example of a representative pixel in a display device according to an exemplary embodiment, and FIG. 9 shows a compensation method according to positions of pixels in a display device according to an exemplary embodiment.

Referring to FIG. 8, representative pixels (Pr) are selected at regular intervals from among the entire pixels PX on the display panel 300 to store the characteristic of the representative pixels (Pr) in the second memory 621, and based on this, second compensation data of the entire pixels PX are generated. At least two pixels PX on corners of various quadrangular sizes such as 4×4, 8×8, or 16×16 may be selected as representative pixels (Pr). The quadrangle may be a square, or may be a rectangle.

FIG. 8 illustrates representative pixels (Pr) for the respective reference gray scales in consideration of the first compensation data. Particularly, when the reference gray scale is the gray scale 16 (16G), the representative pixel (Pr) is illustrated for the entire display panel 300, and in the case of other reference gray scales, the representative pixels (Pr) are illustrated on the corners of the display panel 300. However, the representative pixels (Pr) are disposed on the whole display panel 300 in the case of the reference gray scales excluding the gray scale 16 (16G).

The characteristic data of the respective representative pixels (Pr) are stored in the second memory 621, so the second compensation data on the representative pixels (Pr) may be easily generated. However, FIG. 9 illustrates a method for generating second compensation data not for the representative pixel (Pr) but for the pixel PX other than the representative pixel (Pr).

FIG. 9 shows an exemplary embodiment for selecting two pixels as representative pixels (Pr) for each 8×8, and the second compensation data at the corresponding pixel A may be found as in Equation 1 by using characteristic data and distances of four adjacent representative pixels (Pr).

$$\text{Second compensation data of pixel } A = \text{Second compensation data } (Pra)\times a + \text{Second compensation data } (Prb)\times b + \text{Second compensation data } (Prc)\times c + \text{Second compensation data } (Prd)\times d \quad \text{[Equation 1]}$$

Here, the second compensation data (Pra) represents second compensation data on the pixel Pra, the second compensation data (Prb) represents second compensation data on the pixel Prb, the second compensation data (Prc) represents second compensation data on the pixel Prc, the second compensation data (Prd) represents second compensation data on the pixel Prd, and a, b, c, and d represent respective distances shown in FIG. 9. A compensation method in a like manner of Equation 1 will also be referred to as bilinear interpolation.

A method for downsizing a display panel and generating second compensation data will now be described with reference to FIG. 10 and FIG. 11, differing from FIG. 8 and FIG. 9.

Figure 10:
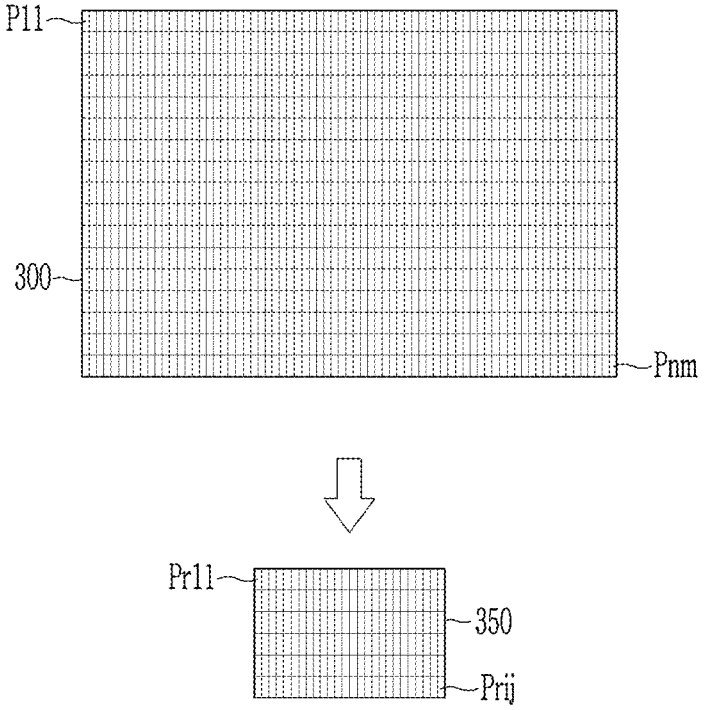
FIG. 10 shows a downsizing method for compensating data in a display device according to an exemplary embodiment.
Figure 11:
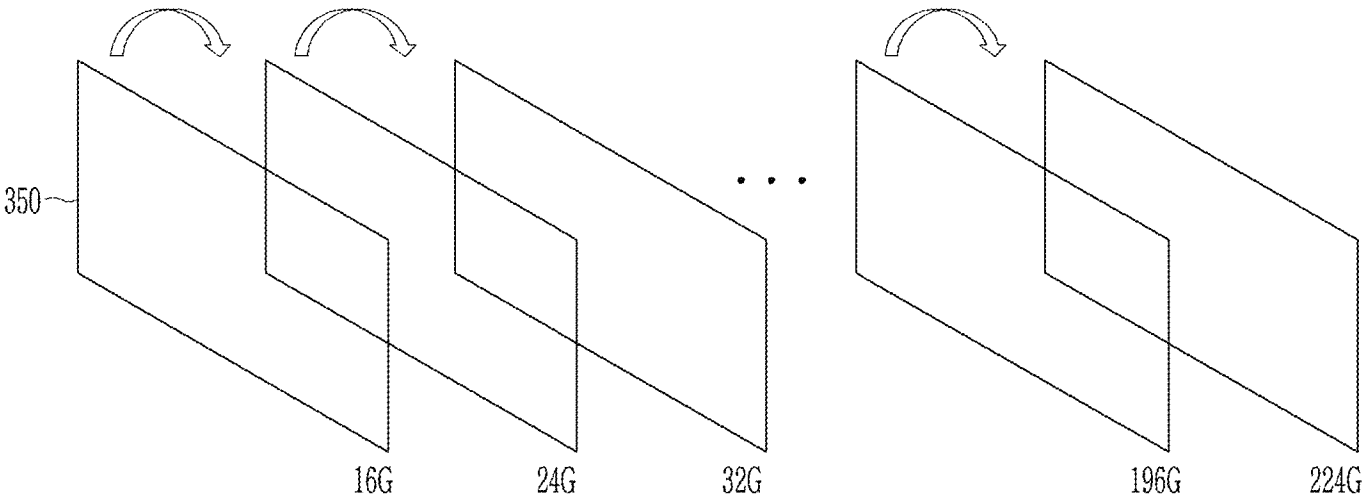
FIG. 11 shows first correction data stored according to a representative gray scale in a display device according to an exemplary embodiment.

FIG. 10 shows a downsizing method for compensating data in a display device according to an exemplary embodiment, and FIG. 11 shows first correction data stored according to a representative gray scale in a display device according to an exemplary embodiment.

In an exemplary embodiment described with reference to FIG. 10, a panel 350 (a downsizing panel, hereinafter) downsized by reducing a number of pixels by a predetermined ratio of magnification on the display panel 300 is virtually formed, and the characteristic on the entire pixels (representative pixels) included in the downsizing panel 350 is stored in the second memory 621. The downsizing panel 350 may be equivalent to the panel on which only the representative pixels (Pr) are gathered in FIG. 8. According to FIG. 10, the downsizing panel 350 includes pixels Pr11 to Prij and i and j are smaller integer value than n and m of the display panel 300.

In an exemplary embodiment using the downsizing panel 350 as described above, the compensation data stored in the first memory 611 and the second memory 621 may be shown as in FIG. 11. That is, the compensation data values on the entire pixels (representative pixels) of the downsizing panel 350 are stored therein for the respective reference gray scales.

The pixels PX that are not included in the downsizing panel 350 are resized to the display panel 300 that is a normal panel, and they are bilinearly interpolated according to FIG. 9 and Equation 1 to generate second compensation data.

Figure 12:
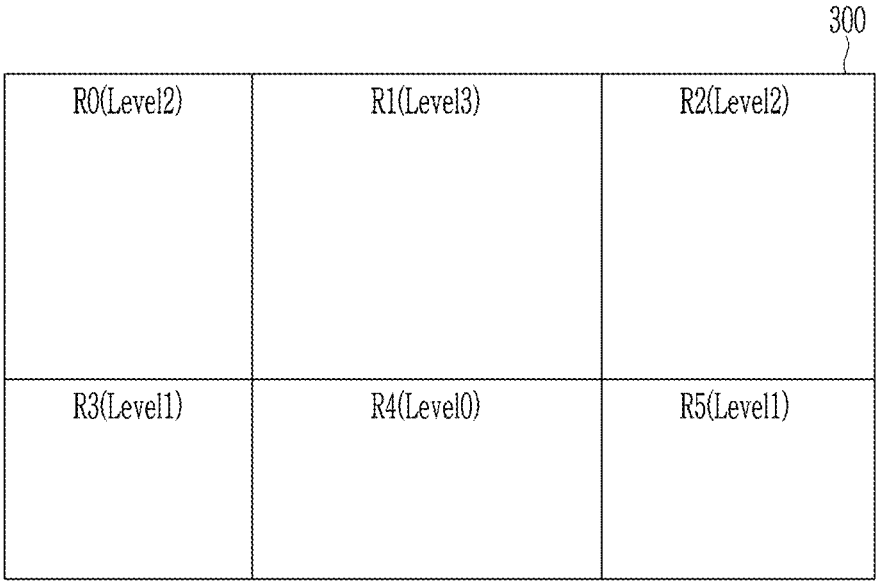
FIG. 12 shows a method for compensating data with different options of multiples with respect to positions in a display device according to an exemplary embodiment.

In another exemplary embodiment, the display panel 300 may be divided into a plurality of regions, and the characteristic of the pixel PX may be reflected with different options of multiples for respective regions, which is shown in FIG. 12.

FIG. 12 shows a method for compensating data with different options of multiples with respect to positions in a display device according to an exemplary embodiment.

FIG. 12 illustrates dividing one display panel 300 into six regions R0, R1, R2, R3, R4, and R5 and providing different options of multiples Level0, Level1, Level2, and Level3 to the respective regions. When Level3 is the maximum option of multiples and Level0 is the minimum option of multiples, the second compensation data generated by the second compensator 620 are changed to the maximum and a final digital image signal DAT is generated on the pixel PX in the region R1 at Level3, and the second compensation data may not be changed and may be determined to be the final digital image signal DAT on the pixel PX in the region R4 at Level0.

In another exemplary embodiment, shapes and a number of the regions for dividing the display panel 300, and the total number of options of multiples, may be variable, differing from FIG. 12.

It has been described in the above exemplary embodiments that the first compensator 610 is first operated, and the second compensator 620 is then operated. However, in another exemplary embodiment, the second compensator 620 may be operated in advance, or the two compensators 610 and 620 may be simultaneously operated and results are synthesized to generate a final digital image signal DAT, or one memory and a compensator may be used to perform a compensation operation. This exemplary embodiment will now be described.

An exemplary embodiment in which the second compensator 620 is first operated and the first compensator 610 is then operated will now be described with reference to FIG. 13.

Figure 13:
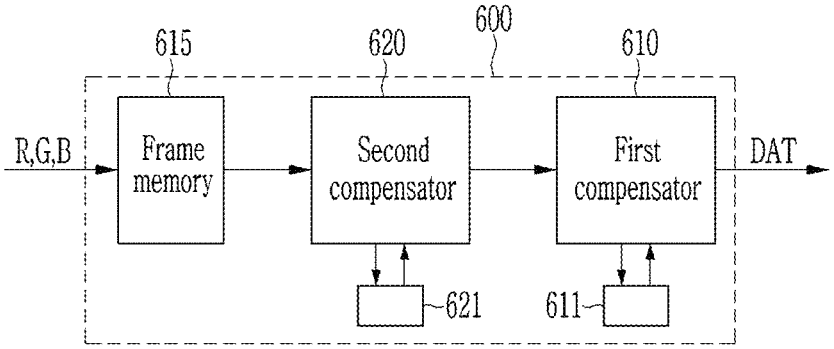
FIG. 13 shows a block diagram of a signal controller in a display device according to an exemplary embodiment.

FIG. 13 shows a block diagram of a signal controller in a display device according to an exemplary embodiment.

Referring to FIG. 13, differing from FIG. 2, input image signals R, G, and B input by an external graphics signal controller are transmitted to the second compensator 620 for generating second compensation data by using the second memory 621 storing a characteristic of the pixel PX to be actually applied.

The second compensation data are transmitted to the first compensator 610, and the first compensation data are generated by using the data stored in the first memory 611 with reference to the second compensation data continuously applied to the data lines D1 to Dm. The compensated first compensation data are transmitted as a digital image signal DAT to the data driver 500, the compensated first compensation data are converted into analog data voltages by using the gray voltage generator 800, and the analog data voltages are applied to the respective data lines D1 to Dm of the display panel 300.

An exemplary embodiment described with reference to FIG. 13 is different from an exemplary embodiment described with reference to FIG. 2 in order, but they are equivalent in performing compensation by considering the characteristic of the pixel PX and the data before/after the data line.

Figure 14:
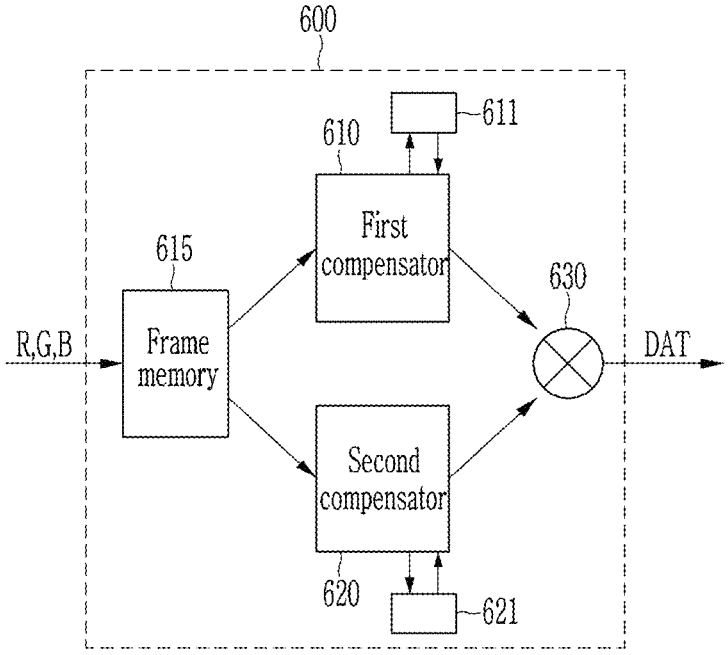
FIG. 14 shows a block diagram of a signal controller in a display device according to an exemplary embodiment.

In another exemplary embodiment, the first compensator 610 and the second compensator 620 may be simultaneously operated, and the results may be synthesized to generate the final digital image signal DAT, which is shown in FIG. 14.

FIG. 14 shows a block diagram of a signal controller in a display device according to an exemplary embodiment.

Referring to FIG. 14, input image signals R, G, and B input by the external graphics signal controller are transmitted to the first compensator 610 and the second compensator 620 to generate first compensation data and second compensation data. The generated first compensation data and second compensation data are transmitted to a synthesizer 630 to synthesize them and generate a final digital image signal DAT. When the synthesizer 630 generates the final digital image signal DAT, it may provide a weight value to determine whether the first compensation data or the second compensation data are further considered. Further, in another exemplary embodiment, the synthesizer 630 may determine a mean value of the first compensation data and the second compensation data, a product of the two values, or a sum of the two values to be the final digital image signal DAT.

Figure 15:
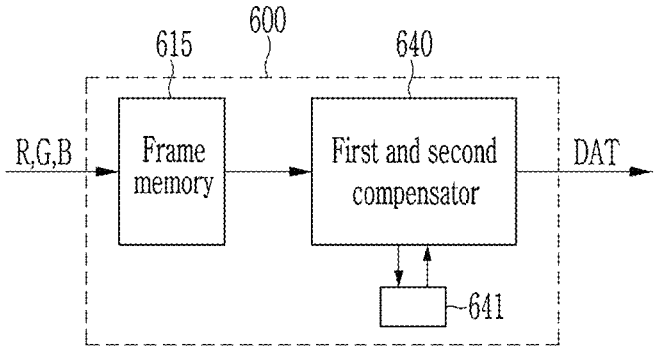
FIG. 15 shows a block diagram of a signal controller in a display device according to an exemplary embodiment.
Figure 16:
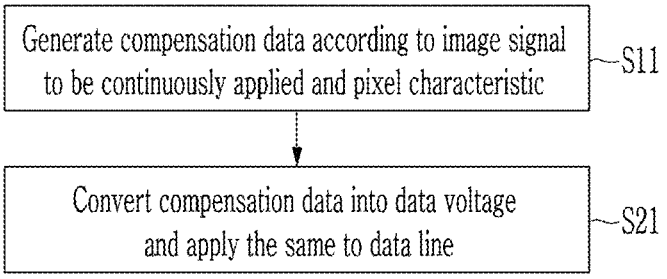
FIG. 16 shows a flowchart of a method for driving a display device according to an exemplary embodiment.

In another exemplary embodiments, one compensator for considering the first compensator and the second compensator may be used, which is shown in FIG. 15 and FIG. 16.

FIG. 15 shows a block diagram of a signal controller in a display device according to an exemplary embodiment, and FIG. 16 shows a flowchart of a method for driving a display device according to an exemplary embodiment.

Referring to FIG. 15, it includes one memory 641 and one compensator 640 (i.e., first and second compensator), and the data stored in the memory 641 include compensation data that are stored in consideration of the items that are considered by the first compensator 610 and the second compensator 620. That is, the compensation data stored in the memory 641 represent the data for performing compensation by considering the characteristic of the pixel PX and the data before/after the data line, so the function of the first compensator 610 and the function of the second compensator 620 may be performed by one compensation process. As a result, the number of memories used for compensation of data, and the data processing time, may also be reduced.

Referring to FIG. 16, compensation data are generated by considering input image signals R, G, and B to be continuously applied to one of the data lines D1 to Dm among the input image signals R, G, and B input from the external graphics signal controller and the characteristic of the pixel PX to be actually applied (S11). The stage of S11 is performed by the first and second compensators 640 including the characteristics of the first compensator 610 and the second compensator 620, and is aided by the memory 641.

The generated compensation data are transmitted as a digital image signal DAT to the data driver 500, which is converted into an analog data voltage by using the gray voltage generator 800, and is applied to the respective data lines D1 to Dm of the display panel 300 (S21). The stage of S21 is performed by the data driver 500, and in this instance, it is aided by the gray voltage generator 800.

In an exemplary embodiment described with reference to FIG. 15 and FIG. 16, the data stored in the memory 641 may be shown as in FIG. 8 and FIG. 10. That is, in FIG. 8 or FIG. 10, while the compensation data are stored for the respective reference gray scales, the compensation data are stored with a sampled representative pixel (Pr) (FIG. 8), or the compensation data are stored for the entire down-sampled pixels (FIG. 10). An adjacent reference gray scale and a representative pixel (Pr) are brought, and they are interpolated to generate a final digital image signal DAT.

In an exemplary embodiment described with reference to FIG. 13 to FIG. 16, the compensation data may be determined by using the worst case for one of the case in which the data voltage falls and the case in which the data voltage rises, and the compensation data may be determined by using the weight value table for the other case.

In the liquid crystal display in the vertical alignment (VA) mode, the worst case having a high probability of generating a charging problem is generated when the data voltage rises, so it has been described that the respective data are found in detail when the data voltage rises, and the compensation data are generated by using a weight value table when the data voltage falls (i.e., when the probability of generating a charging problem is low). However, in the liquid crystal display in the horizontal alignment mode, the worst case having a high probability of generating a charging problem is generated when the data voltage falls, so the compensation data when the data voltage rises (i.e., when the probability of generating a charging problem is low) may be generated by using a weight value table.

Further, the capacity of the data stored by using the option of multiples may be reduced according to an exemplary embodiment described with reference to FIG. 13 to FIG. 16.

The content described with reference to FIG. 2 to FIG. 16 is applicable to the emissive display device. That is, as the high-resolution display device is used, the time for charging respective pixel rows is substantially reduced, so the data voltage must be applied for an insufficient time in the emissive display device. Therefore, as described with reference to FIG. 2 to FIG. 16, the worst case in which a charging defect may be generated is found by considering the adjacent input image signal to be applied to one data line, the compensation data are set for the worst case of one of the case in which the data voltage falls and the case in which the data voltage rises, and the compensation data may be set by using a weight value table in the other case.

Further, compensation is performed by considering the characteristic caused by the position of pixels, and in the case of the emissive display device, the compensation caused by a threshold voltage of a driving transistor may also be considered.

In addition, the capacity of the stored data may be reduced by using the option of multiples.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

| <Description of symbols> | |
|---|---|
| 300: display panel | 350: downsizing panel |
| 400: gate driver | 500: data driver |
| 600: signal controller | 800: gray voltage generator |
| G1-Gn: gate line | D1-Dm, 171: data line |
| P11-Pnm, PX: pixel | Pr: representative pixel |
| R, G, B: input image signal | DAT: digital image signal |
| 610: first compensator/adjacent image signal compensator | |
| 620: second compensator/pixel characteristic compensator | |
| 615: frame memory | 630: synthesizer |
| 640: first and second compensator | 611, 621, 641: memory |

What is claimed is:

1. A display device comprising:

a display panel including a plurality of pixels, and a plurality of data lines connected to the plurality of pixels;

a data driver which transmits a data voltage to the data line;

a signal controller including an adjacent image signal compensator and a pixel characteristic compensator which receives input image signals from an outside and outputs a digital image signal to the data driver;

a first memory which stores information used when the adjacent image signal compensator generates adjacent image signal compensation data, wherein the adjacent image signal compensator compares input gray data of the input image signals to be continuously input to the data line and generates the adjacent image signal compensation data based on the comparison, wherein the pixel characteristic compensator which generates pixel characteristic compensation data according to a characteristic of a pixel to be displayed, wherein the information stored in the first memory includes some reference gray scales from among entire gray scales, wherein the information stored in the first memory further includes a weight value table, and the weight value table is applied in a case in which a probability of generating a drawback in charging is low to thus generate the adjacent image signal compensation data, and the drawback in charging includes insufficient charging.

2. The display device of claim 1, wherein the adjacent image signal compensator generates the adjacent image signal compensation data by using an option of multiples.

3. The display device of claim 1, wherein the adjacent image signal compensator generates the adjacent image signal compensation data by interpolating gray scales except for the reference gray scale from among the entire gray scales.

4. The display device of claim 1, further comprising a second memory which stores information used when the pixel characteristic compensator generates the pixel characteristic compensation data.

5. The display device of claim 4, wherein the information stored in the second memory includes pixel characteristic information on only a representative pixel set by sampling or downsizing some of the plurality of pixels.

6. The display device of claim 1, wherein the signal controller further includes a frame memory which stores the input image signal for each frame, and transmits the input image signal to the adjacent image signal compensator or the pixel characteristic compensator.

7. The display device of claim 6, wherein the frame memory transmits the input image signal to the adjacent image signal compensator, and the adjacent image signal compensator transmits the adjacent image signal compensation data to the pixel characteristic compensator to generate the digital image signal.

8. The display device of claim 6, wherein the signal controller further includes a synthesizer, the frame memory transmits the input image signal to the adjacent image signal compensator and the pixel characteristic compensator, and the adjacent image signal compensator and the pixel characteristic compensator transmit the adjacent image signal compensation data and the pixel characteristic compensation data, respectively, to the synthesizer to generate the digital image signal.

9. The display device of claim 6, wherein the signal controller further includes a third memory which stores information for both compensation based on the input gray data to be continuously input and compensation according to the characteristic of the pixel to be displayed, and the adjacent image signal compensator and the pixel characteristic compensator configure one compensator, and generate the digital image signal by using the information stored in the third memory.

10. A display device comprising:

a display panel including a plurality of pixels, and a plurality of data lines connected to the plurality of pixels;

a data driver which transmits a data voltage to the data line;

a signal controller including an adjacent image signal compensator and a pixel characteristic compensator which receives input image signals from an outside and outputs a digital image signal to the data driver, and including;

a memory which stores information used when the pixel characteristic compensator generates pixel characteristic compensation data, wherein the adjacent image signal compensator compares input gray data of the input image signals to be continuously input to the data line and generates adjacent image signal compensation data based on the comparison, the pixel characteristic compensator generates the pixel characteristic compensation data according to a characteristic of a pixel to be displayed, the information stored in the memory includes pixel characteristic information on only a representative pixel set by sampling or downsizing some of the plurality of pixels, and the representative pixel is provided in plural, and the pixel characteristic compensator generates the pixel characteristic compensation data based on the pixel characteristic information of four representative pixels adjacent to the pixel to be displayed and a distance from each of the four representative pixels to the pixel to be displayed.

11. The display device of claim 10, wherein the pixel characteristic compensator generates the pixel characteristic compensation data by using an option of multiples.

12. The display device of claim 11, wherein the pixel characteristic compensator divides the display panel into a plurality of regions, and compensates respective regions with options of multiples different from each other to generate the pixel characteristic compensation data.

13. A display device comprising:

a display panel including a plurality of pixels, and a plurality of data lines connected to the plurality of pixels;

a data driver which transmits a data voltage to the data line; and a signal controller which receives input image signals from an outside and outputs a digital image signal to the data driver, wherein the signal controller includes an adjacent image signal compensator which compares input gray data of the input image signals to be continuously input to the data line and generates adjacent image signal compensation data based on the comparison, and a pixel characteristic compensator which generates pixel characteristic compensation data according to a characteristic of a pixel to be displayed, wherein the signal controller further includes a frame memory which stores the input image signal for each frame, and transmits the input image signal to the adjacent image signal compensator or the pixel characteristic compensator, the frame memory transmits the input image signal to the pixel characteristic compensator, and the pixel characteristic compensator transmits the pixel characteristic compensation data to the adjacent image signal compensator to generate the digital image signal.

14. A method for driving a display device, comprising:

generating adjacent image signal compensation data by comparing input gray data of input image signals to be continuously input to one data line;

generating pixel characteristic compensation data with respect to a position of a pixel to be displayed; and converting a digital image signal generated by the generating of the adjacent image signal compensation data and the generating of the pixel characteristic compensation data into a data voltage and applying the data voltage, wherein the generating of the adjacent image signal compensation data includes generating the adjacent image signal compensation data by using a weight value table when a probability in which a pixel has a charging drawback is low, and the charging drawback includes insufficient charging.

15. The method of claim 14, wherein the generating of the pixel characteristic compensation data includes:

setting a representative pixel by sampling or downsizing a plurality of pixels included in a display panel of the display device, the representative pixel being provided in plural, storing pixel characteristic information on the representative pixel, and generating the pixel characteristic compensation data based on the characteristic information of a four representative pixels adjacent to the pixel to be displayed and a distance from each of the four representative pixels to the pixel to be displayed.

16. The method of claim 15, wherein the generating of the adjacent image signal compensation data or the generating of the pixel characteristic compensation data includes using an option of multiples.

17. The method of claim 15, wherein the generating of the pixel characteristic compensation data includes dividing the display panel into a plurality of regions, and compensating respective regions with different weight values to generate the pixel characteristic compensation data.

* * * * *